United States Patent [19]

Beane

[11] 4,288,321

[45] Sep. 8, 1981

[54] DRAIN TILE AND PILE FABRIC FILTER SLEEVE

[76] Inventor: Frank T. Beane, Rte. 7, Hwy. 49, Concord, N.C. 28025

[21] Appl. No.: 96,643

[22] Filed: Nov. 23, 1979

Related U.S. Application Data

[60] Continuation-in-part of Ser. No. 626,630, Oct. 29, 1975, Pat. No. 4,180,464, which is a division of Ser. No. 483,391, Jun. 25, 1974, Pat. No. 3,976,578.

[51] Int. Cl.[3] ..... E02B 13/00; B01D 29/14

[52] U.S. Cl. ..... 210/170; 210/489; 210/497.1; 210/507; 405/45

[58] Field of Search ..... 210/170, 501, 489, 507, 210/490, 491, 497 R; 405/45

[56] References Cited

U.S. PATENT DOCUMENTS

| | | | |
|---|---|---|---|
| 2,546,874 | 3/1951 | Siegrist | 210/489 |
| 3,062,379 | 11/1962 | Bryan | 210/507 X |
| 3,830,373 | 8/1974 | Sixt | 210/489 |
| 3,917,530 | 11/1975 | Boske | 210/170 X |
| 3,946,762 | 3/1976 | Green | 405/45 |
| 3,976,578 | 8/1976 | Beane | 210/484 |
| 4,019,326 | 4/1977 | Harveling | 405/45 |
| 4,180,464 | 12/1974 | Beane | 210/497.1 |

FOREIGN PATENT DOCUMENTS

| | | | |
|---|---|---|---|
| 1576289 | 6/1969 | France | 405/45 |
| 703595 | 2/1954 | United Kingdom | 405/45 |

*Primary Examiner*—Frank A. Spear, Jr.

[57] ABSTRACT

A land drainage line having a tube or the like forming a conduit through which water will be drained and a knitted pile fabric filter sleeve around the drainage line.

5 Claims, 5 Drawing Figures

DRAIN TILE AND PILE FABRIC FILTER SLEEVE

RELATED APPLICATIONS

This application is a continuation-in-part of co-pending application Ser. No. 626,630 filed Oct. 29, 1975 now U.S. Pat. No. 4,180,464 issued Dec. 25, 1979 and which is in turn a division of prior application Ser. No. 483,391 filed June 25, 1974 and now U.S. Pat. No. 3,976,578 issued Aug. 24, 1976.

FIELD AND BACKGROUND OF INVENTION

Land drainage has long been accomplished through underground conduits or pipes formed of tile or tubing. Particularly in recent years, land drainage has been accomplished by the installation of flexible corrugated drainage tubing. In connection with such land drainage, it has long been recognized that certain soils will quickly clog drainage lines that may be installed unless provision is made for protecting the drain tile or tubing against intrusion of soil particles. Various filter materials have been proposed and have been developed for preventing such early blockage of a drainage line, including the knit fabric protective sleeves or filters described in and protected by the patents resulting from the aforementioned related applications.

It has also been discovered that certain chemical reactions occurring in soil may contribute to blockage or filling of drain lines. In particular, difficulty has occurred with a particular iron composition known in the land drainage industry as ocher. While the filter arrangements currently in use within the land drainage industry successfully deal with intrusion by fine soil particles, difficulty has upon occasion been encountered with ocher and with other similar chemical reaction related particles which may accumulate on filter surfaces or within drainage lines.

BRIEF SUMMARY OF INVENTION

With the above discussion particularly in mind, it is an object of the present invention to provide a filter media and the combination of such a filter media with a land drainage conduit which is capable of enhanced filtration capabilities under difficult circumstances such as the presence of chemical reaction particles. In realizing this object of the present invention, a pile fabric is employed for a protective filter sleeve, with the pile surface of the fabric facilitating efficient liquid flow into a drainage conduit notwithstanding any accumulation of chemical reaction particles.

A further object of the present invention is to provide a drainage conduit and a protective sleeve for the conduit which facilitates the inclusion, in such a combination, of chemical compounds effective to neutralize or minimize the interference with drainage caused by chemical reaction particles such as ocher. In accordance with this aspect of the present invention, a pile portion of the knit fabric protective sleeve contemplated by the present invention is impregnated with suitable chemical agents for counteracting anticipated chemical reaction particle intrusions.

BRIEF DESCRIPTION OF DRAWINGS

Some of the objects of the invention having been stated, other objects will appear as the description proceeds, when taken in connection with the accompanying drawings, in which—

DETAILED DESCRIPTION OF INVENTION

While the present invention will be described more fully hereinafter with particular reference to the accompanying drawings, it is to be understood at the outset of the following description that it is contemplated that persons skilled in the appropriate arts of manufacturing knitted fabrics and of installing land drainage lines with filters will be enabled, by the disclosure which follows, to construct and use land drainage lines other than those here specifically described while attaining the favorable results of the present invention. Accordingly, the following description is to be taken broadly as an enabling teaching directed to persons skilled in the appropriate arts, and not as restrictive upon the scope of this invention.

Figure 1:
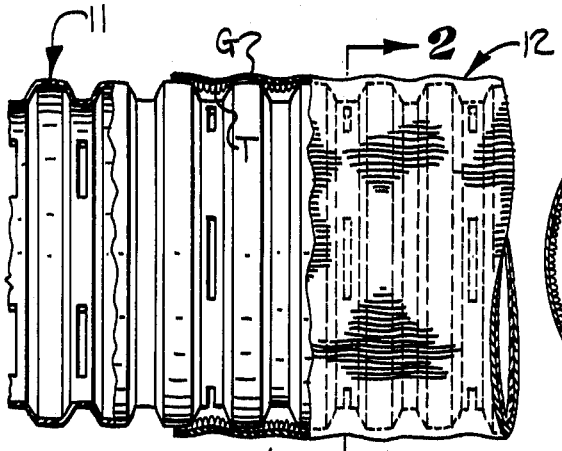
FIG. 1 is an elevation view, partly broken away, of a drain line in accordance with the present invention.
Figure 2:
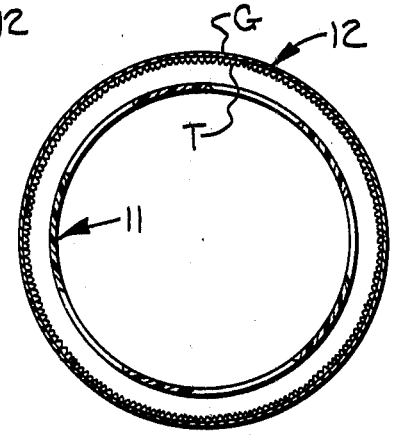
FIG. 2 is an elevation view, in section, taken generally along the line 2—2 in FIG. 1 and showing the filter material of the present invention as installed about a drainage tube.

Referring now more particularly to the accompanying drawings, a drain line is there shown (in FIGS. 1 and 2) which bears substantial similarity to the drain lines illustrated and described in the aforementioned related applications. To any extent necessary to provide a full understanding of the present invention, the description to be found in prior U.S. Pat. No. 3,976,578 is hereby incorporated by reference into this description. In the particular form illustrated, the drain line includes a corrugated, flexible drainage pipe or tube 11 and a knit fabric filter 12 extending over the outer surface of the tube 11. As wil be appreciated by persons knowledgeable in the land drainage art, the drain line of the present invention may incorporate flexible corrugated drainage tubing made of plastic material (as illustrated in FIGS. 1 and 2) or may incorporate "hard tile" made of clay, concrete, or other materials and formed in relatively short lengths. The present invention specifically contemplates that a land drainage line may use a conduit of either type, notwithstanding the specific illustration of a flexible corrugated drainage tube 11.

Figure 3:
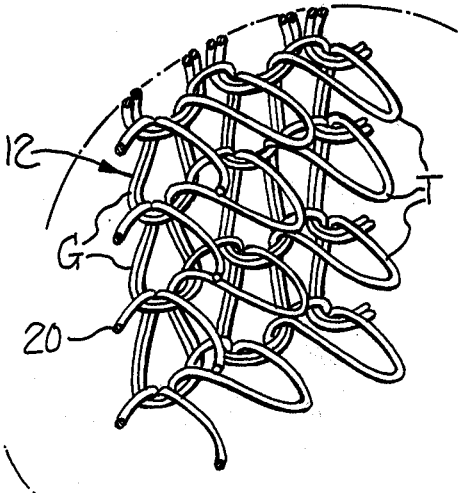
FIG. 3 is a schematic perspective view of a knit fabric forming the filter in the drain line of FIGS. 1 and 2.
Figure 4:
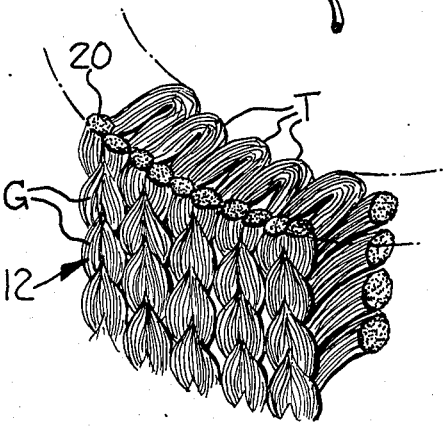
FIG. 4 is a partial perspective view of a portion of the fabric, viewed from the exterior of the drain line as shown in FIGS. 1 and 2.
Figure 5:
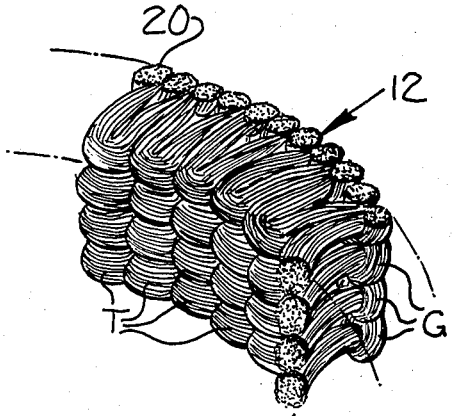
FIG. 5 is a view similar to FIG. 4, as though from the inside of the drain line of FIGS. 1 and 2.

In accordance with particular features of the present invention, the filter sleeve 12 used in the drain line of the present invention comprises knitted pile fabric, preferably terry loop fabric mounted with the loop pile directed radially inwardly toward the longitudinal axis of the enclosed tubing 11 or tile. More particularly, the material used as the sleeve 12 comprises synthetic multi-filament yarn formed into stitches having particular characteristics. The yarn 20 (FIGS. 3 through 5) preferably is crimped multi-filament polyester yarn having a suitable denier which may be in a range of from about 70 to about 150. Preferably, the yarn 20 is circularly knitted into a tube of predetermined diameter and of an indeterminate continuous length of up to 1,000 feet. Certain of the yarns (indicated at G in FIGS. 3 through 5) are knitted into stitches defining a ground or base fabric, while others of the yarns (T in FIGS. 3 through 5) are knitted into stitches defining terry loops extending from the ground to a predetermined height of from about 1 to about 10 millimeters. The fabric is knitted in such a way that the stitches in the ground portion of the fabric define open areas of a selected micron size, preferably less than about 100 microns. By virtue of the knitting of the yarn into stitches defining both a ground and pile loops extending from the ground, the stitch structure is locked against undesirable distortion and opening of the fabric, in a manner distinct from woven fabrics. Further, the fabric is locked against runs and enhanced resistance to abrasion or tearing is imparted. As herein used, the term "pile fabric" refers to any knitted pile fabric including both terry loop and other pile constructions. While it is preferred that the fabric be knit in the form of a tube having a diameter in a relaxed condition less than the maximum diameter of the tubing 11 so as to have an undulating surface when positioned on the tube, it is appreciated that the fabric may be opened into a flat or web form and subsequently cut and sewn in whatever manner is necessary or appropriate to form a tube of the correct diameter.

In use, the filter sleeve 12 preferably is mounted in such a way that the piles T extend radially inwardly toward the enclosed tube 11. In such an arrangement, the pile serves to somewhat separate or space the ground portion of the knitted sleeve from the corrugations of the tube 11 while facilitating flow longitudinally of the tube from one circular drainage channel to an adjacent circular drainage channel. By such flow longitudinally of the tube 11 along the external surface thereof and between the external surface and the ground portion of the knitted fabric, blockage otherwise possible arising from deposition of chemical reactive particles is minimized.

In accordance with one contemplated feature of the present invention, a knitted filter sleeve 12 so installed may have the pile portion thereof treated with an appropriate chemical compound impregnant effective for resisting formation of or dissolving chemical reaction particles which might otherwise block flow through the drainage line. Additionally, the knitted tube used as the filter sleeve 12 may be everted, to be positioned on the tube 11 with the pile facing radially outwardly where direct contact between the pile and soil particles is deemed desirable or appropriate.

As will be appreciated by persons familiar with the art of textile fabric impregnation, the presence of the piles T in the knitted filter sleeve 12 in accordance with the present invention will substantially enhance retention of the chemical compound impregnant deposited thereon. Such persons will further appreciate that such impregnation may be by means of liquids, pastes, powders or the like and that the chemical compound impregnant may be bound to the piles T in a number of different ways. As will be appreciated, the specific chemical compound impregnant chosen may vary with specific soil conditions. Inasmuch as the full range of soil conditions in which the filter of the present invention may be employed is not known at this time, no specific chemical compound impregnant is here suggested.

In the drawings and specification, there has been set forth a preferred embodiment of the invention, and although specific terms are employed, they are used in a generic and descriptive sense only and not for purposes of limitation.

That which is claimed is:

1. In a land drainage line having an elongated flexible corrugated drainage conduit of the type having alternating peaks and valleys along its longitudinal axis and a plurality of openings through the conduit arranged along its longitudinal axis and in valleys of the conduit and a knitted fabric filter sleeve in the form of a length of tubular knit fabric having a length substantially coextensive with the length of the conduit and a diameter in relaxed condition less than the maximum diameter of the conduit, the sleeve covering the drainage conduit and filtering fine particles of soil from water passing through the sleeve and into the drainage conduit, the improvement in the knitted fabric filter sleeve comprising the fabric being formed of stitches defining a ground and defining terry loops extending from the ground and being directed in a predetermined generally radial direction relative to the longitudinal axis of the drainage conduit.

2. A land drainage line according to claim 1 wherein said knitted fabric filter sleeve has said terry loops directed radially inwardly toward said drainage conduit.

3. A land drainage line according to claim 1 wherein said knitted fabric filter sleeve has said terry loops directed radially outwardly away from said drainage conduit.

4. A land drainage line according to one of claims 2 or 3 wherein said terry loops extend from said ground for a distance of from about 1 to about 10 millimeters.

5. A land drainage line according to one of claims 2 or 3 further comprising an impregnant effective for resisting formation of chemical reaction particles and being present in said terry loops.

* * * * *